US007426846B2

(12) United States Patent
Urabe

(10) Patent No.: US 7,426,846 B2
(45) Date of Patent: Sep. 23, 2008

(54) AUTOMATIC BENDING MACHINE FOR MANUFACTURING OF STEEL RULE CUTTING DIES

(76) Inventor: Toshinaga Urabe, 3-20-21, Sounan, Sagamihara-shi, Kanagawa-ken 228-0812 (JP)

( * ) Notice: Subject to any disclaimer, the term of this patent is extended or adjusted under 35 U.S.C. 154(b) by 60 days.

(21) Appl. No.: 11/201,133

(22) Filed: Aug. 11, 2005

(65) Prior Publication Data

US 2006/0266091 A1 Nov. 30, 2006

(30) Foreign Application Priority Data

May 27, 2005 (JP) ..... 2005-184059

(51) Int. Cl.
*B21D 5/16* (2006.01)
*B21D 11/00* (2006.01)

(52) U.S. Cl. ..... 72/307

(58) Field of Classification Search ..... 72/307, 72/319, 388, 387, 217, 214
See application file for complete search history.

(56) References Cited

U.S. PATENT DOCUMENTS 5,507,168 A * 4/1996 Mizukawa et al. ..... 72/387
5,787,750 A 8/1998 Song
6,308,551 B1 * 10/2001 Park ..... 72/307
6,629,442 B2 10/2003 Park
2006/0260377 A1 * 11/2006 Kane et al. ..... 72/307

FOREIGN PATENT DOCUMENTS

JP 62-181835 * 8/1987
JP 11-347828 12/1999
JP 2001-314932 11/2001

* cited by examiner

*Primary Examiner*—Daniel C Crane
(74) *Attorney, Agent, or Firm*—Wenderoth, Lind & Ponack, LLP

(57) ABSTRACT

A setup method for preventing a "two-leaf cutting" by only operating a machine without using fingers in cutting an end of a strip blade material having an enclosed rectangular geometry. The steps include: the strip blade material being once advanced to a position, where "two-leaf cutting" will not occur; then a cutting tool being lowered; a cutting tool tip of a cutting tool component being lowered to a level of the same as or under that of a top edge of the strip blade material; then the strip blade material being retracted; and finally, the strip blade material being retracted by the same amount as that of the advance from the desired position.

5 Claims, 14 Drawing Sheets

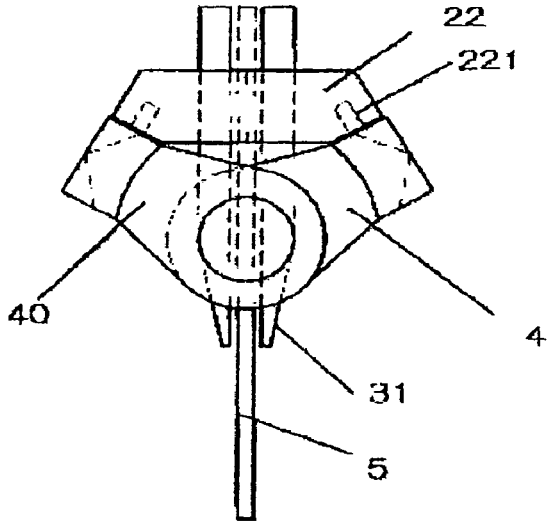
FIG.4-A
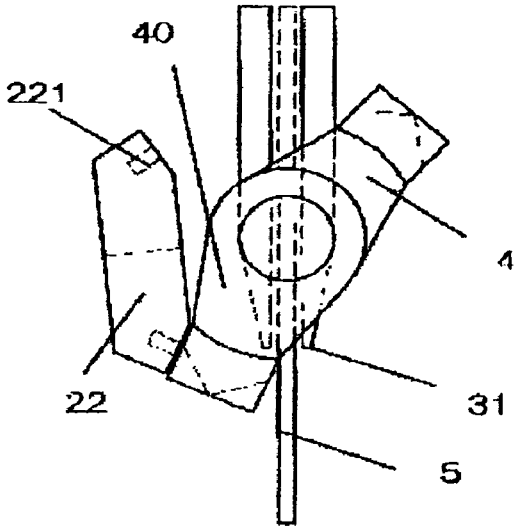
FIG.4-B
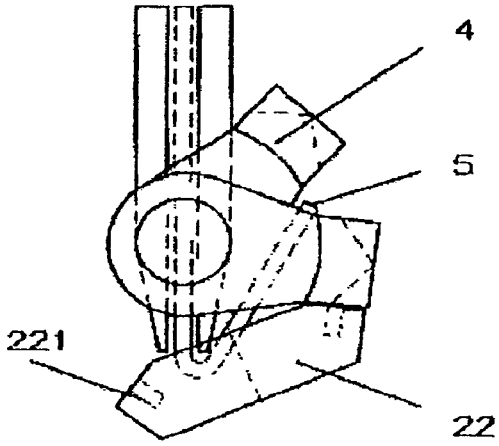
FIG.4-C

FIG.5-A
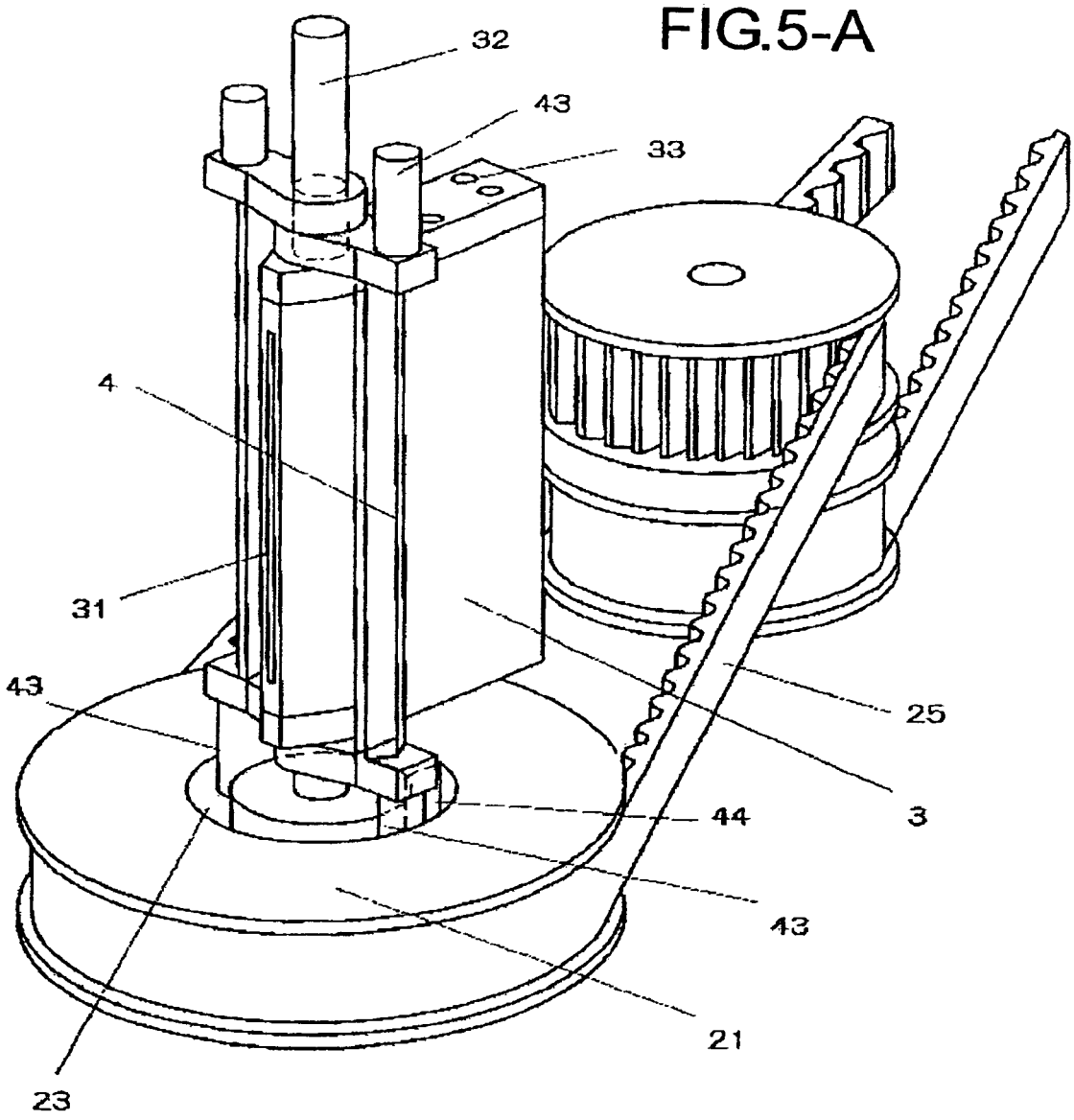
FIG.5-B
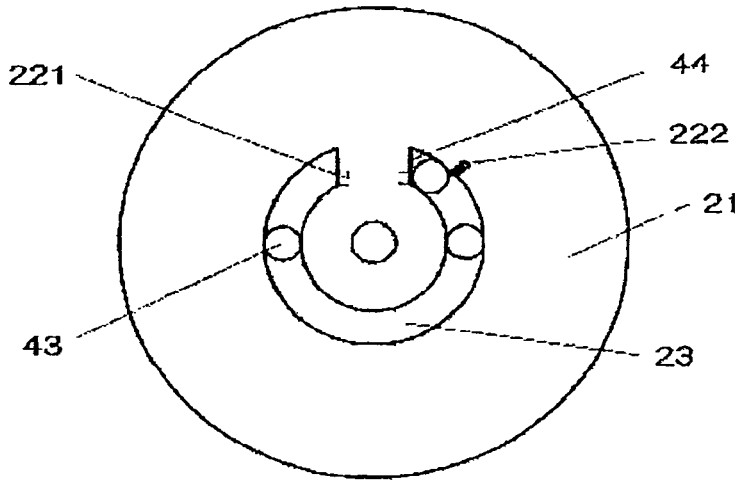

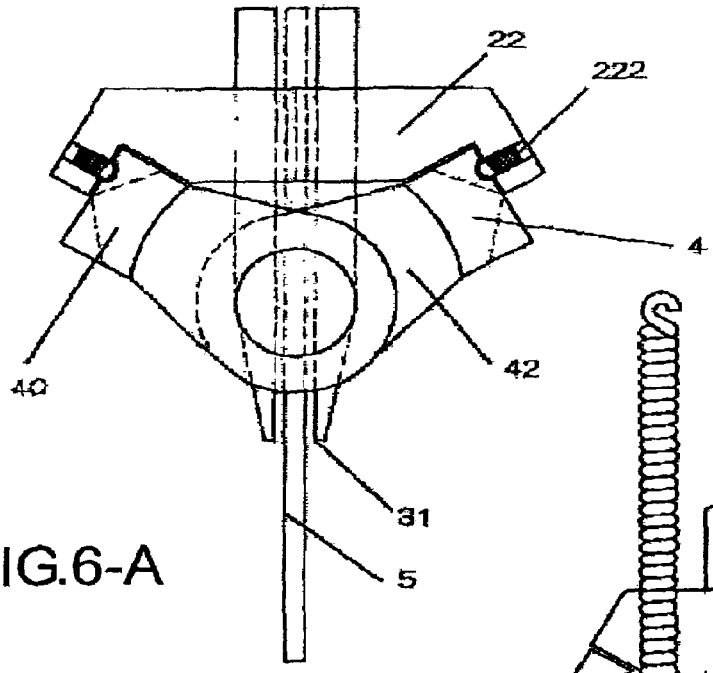
FIG.6-A
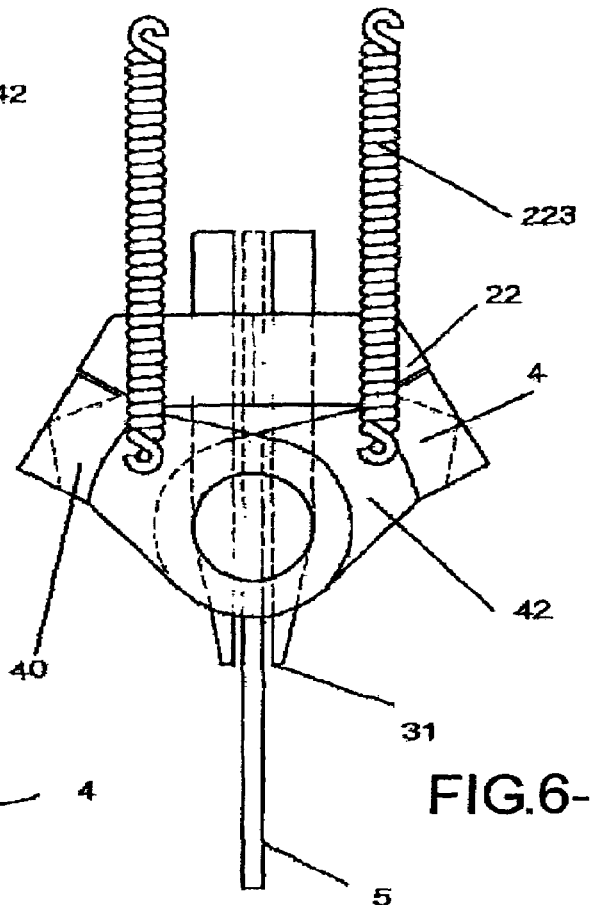
FIG.6-B
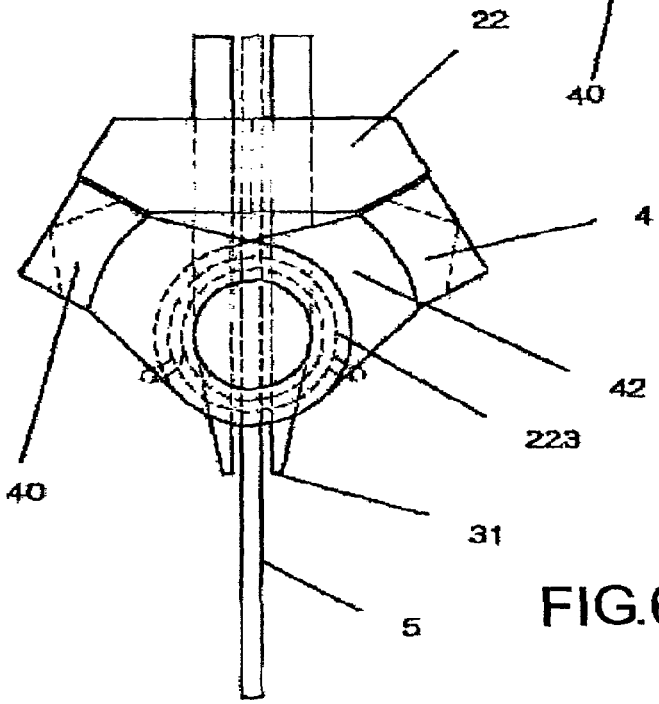
FIG.6-C

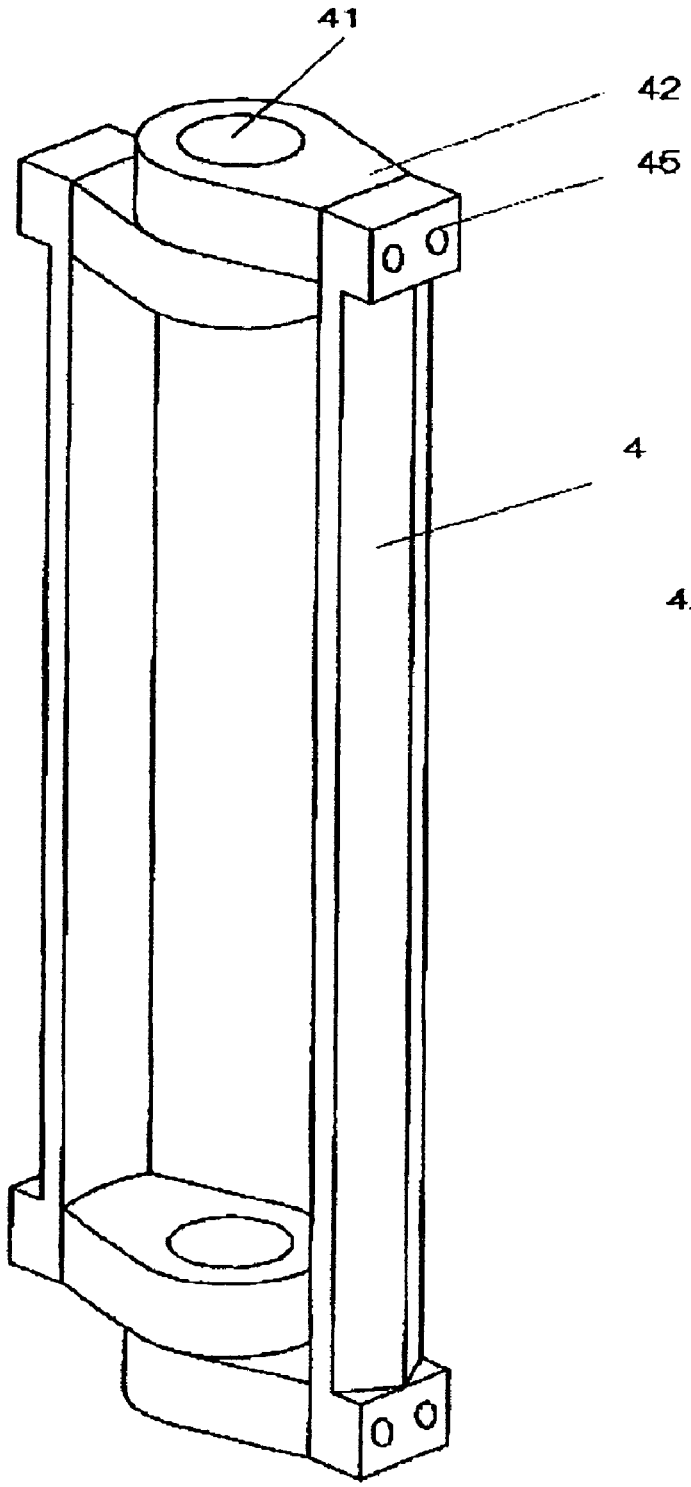
FIG.7-A
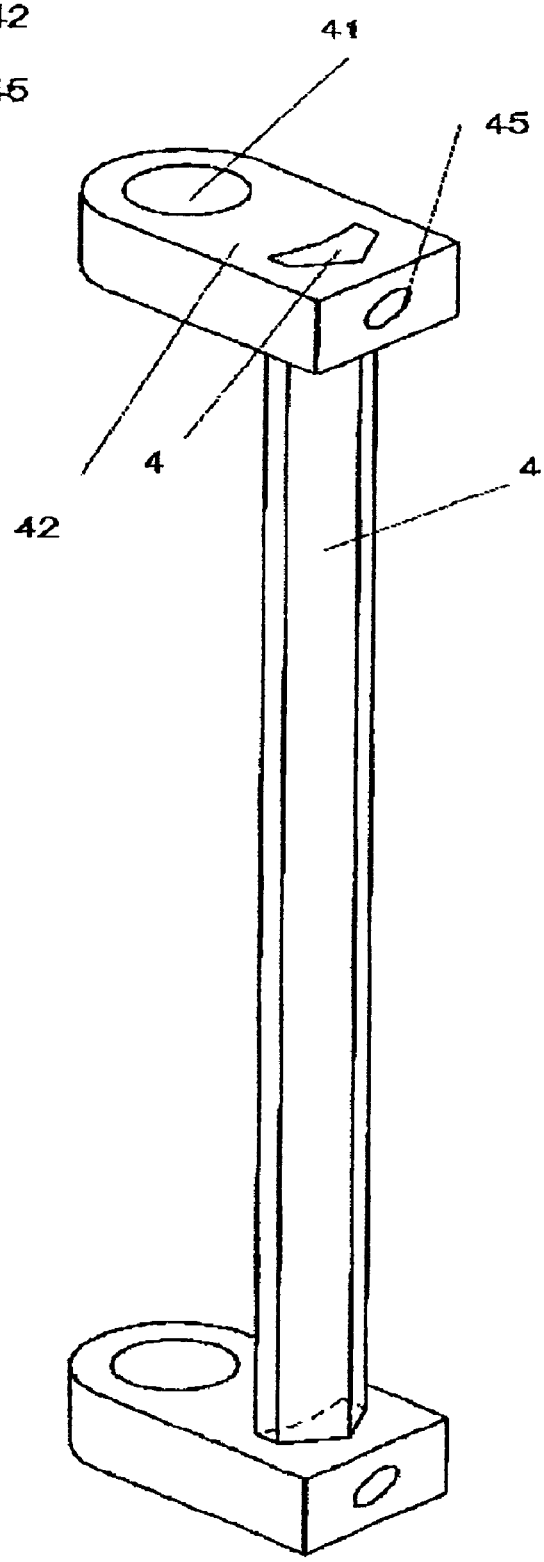
FIG.7-B

FIG.8-A
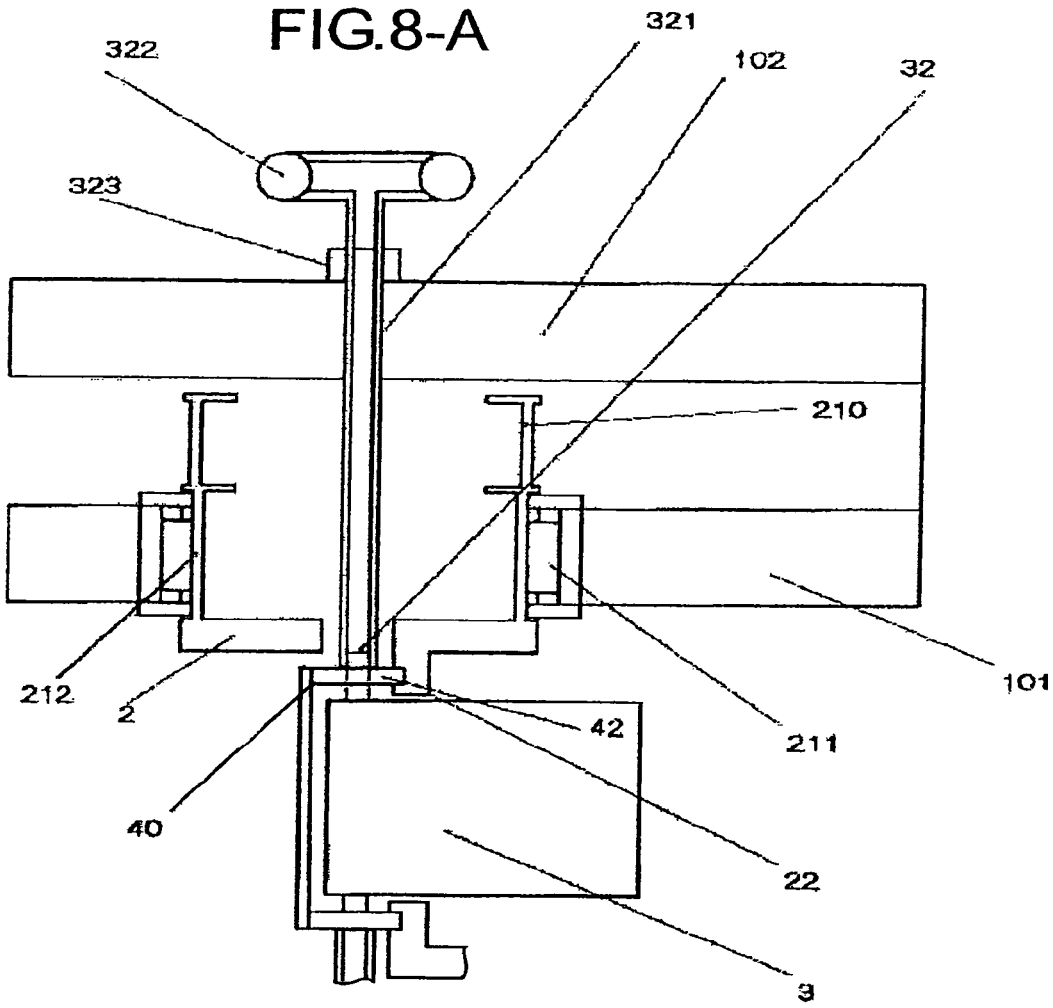
FIG.8-B
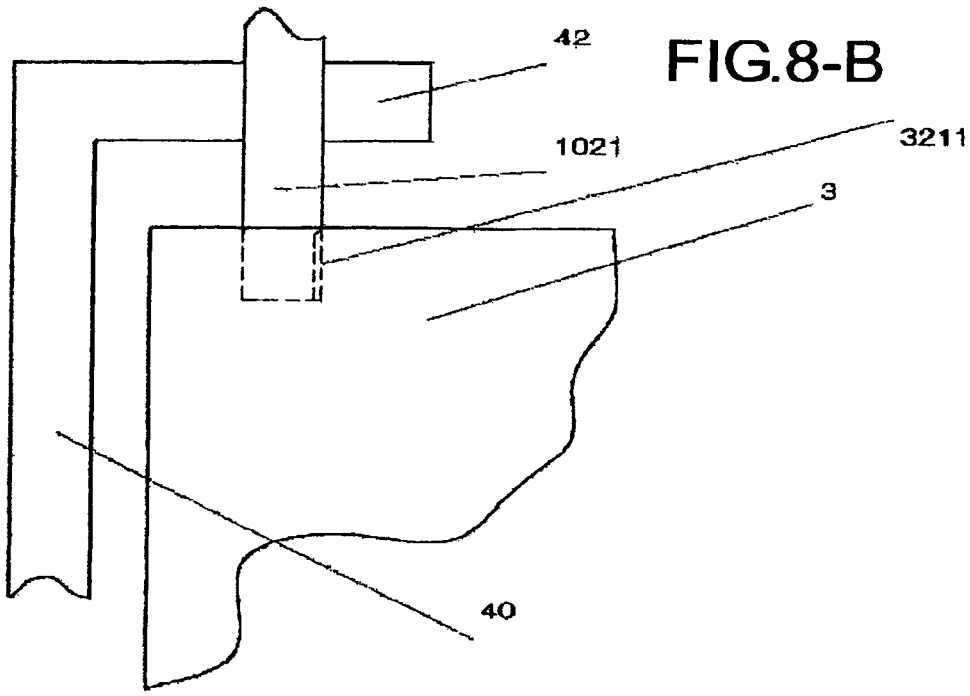

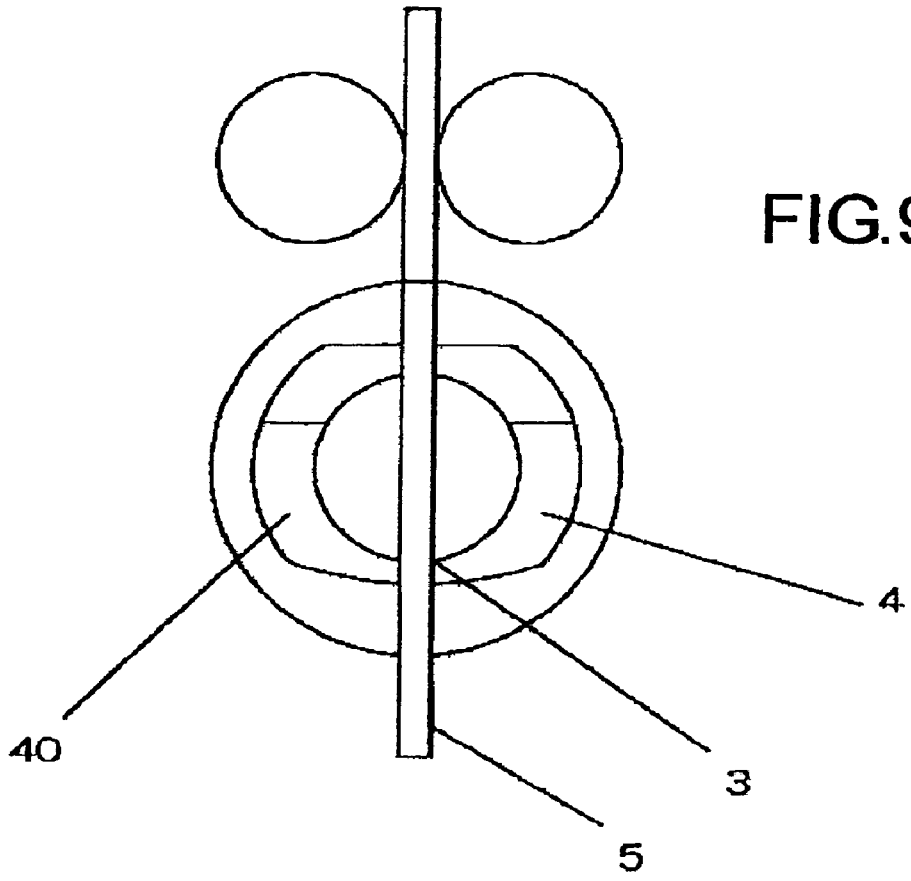
FIG.9-A
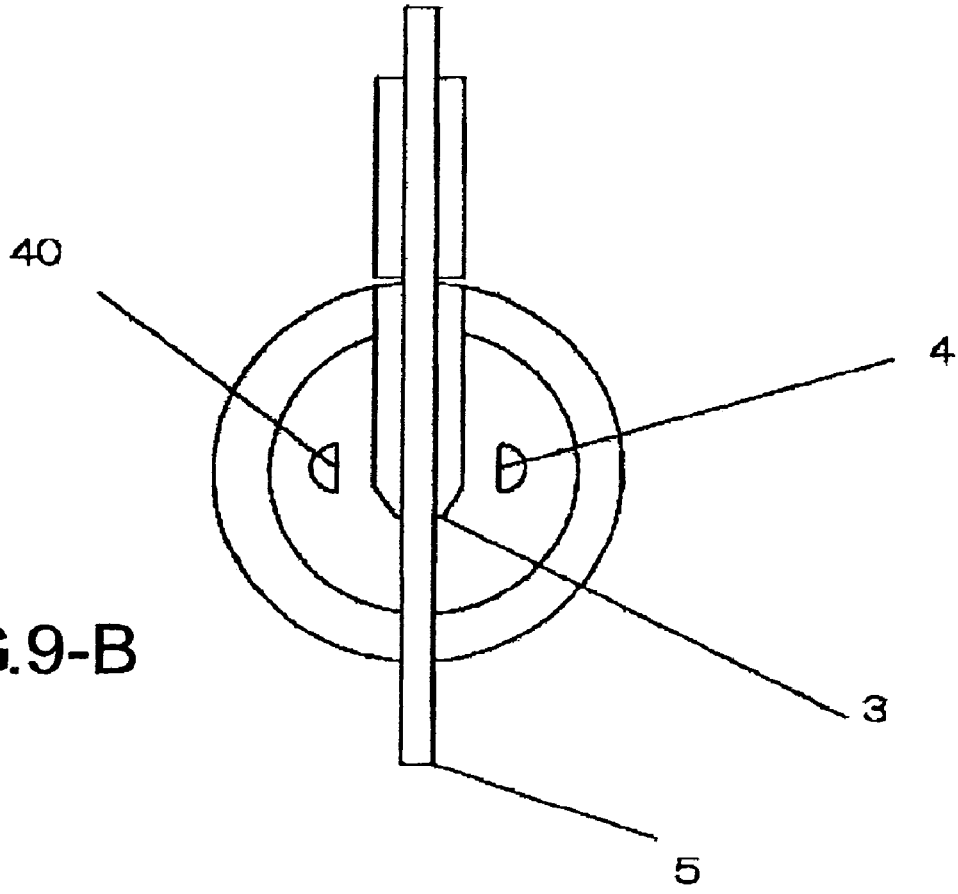
FIG.9-B

FIG.10-A
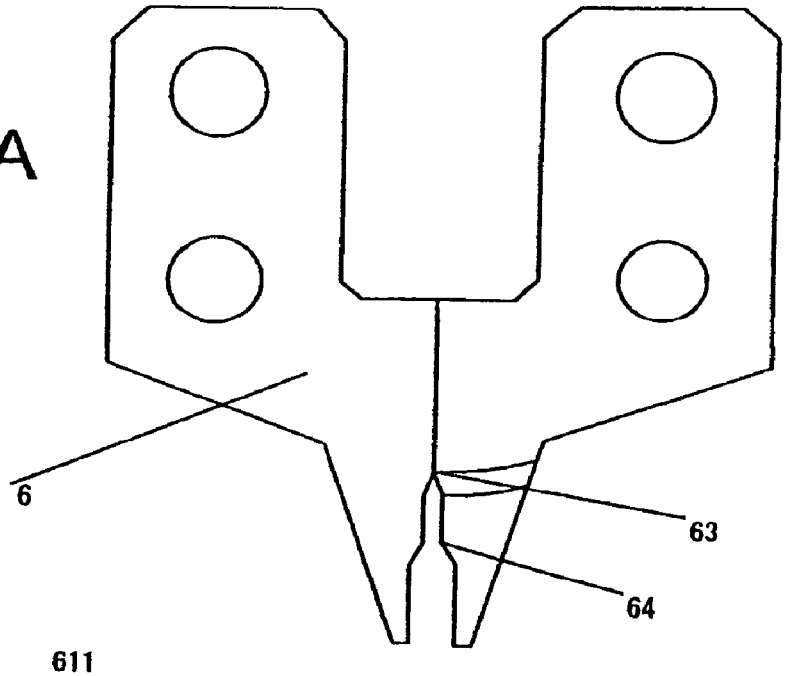
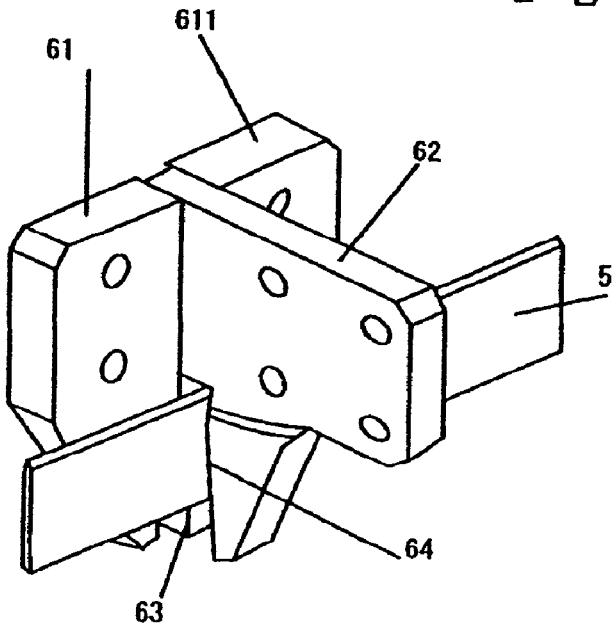
FIG.10-B
FIG.10-C
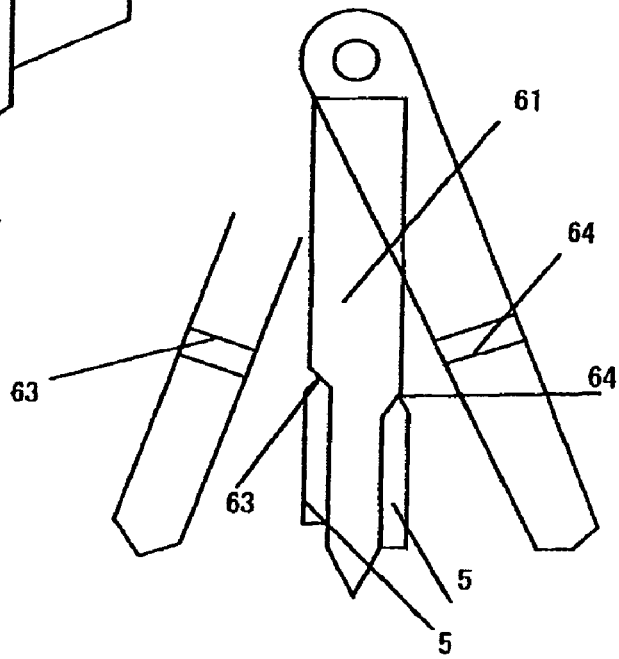

FIG.11-A
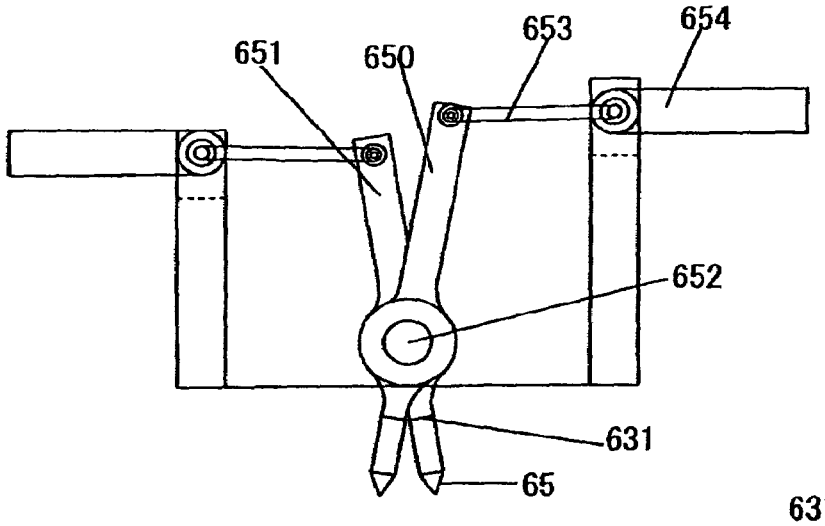
FIG.11-B
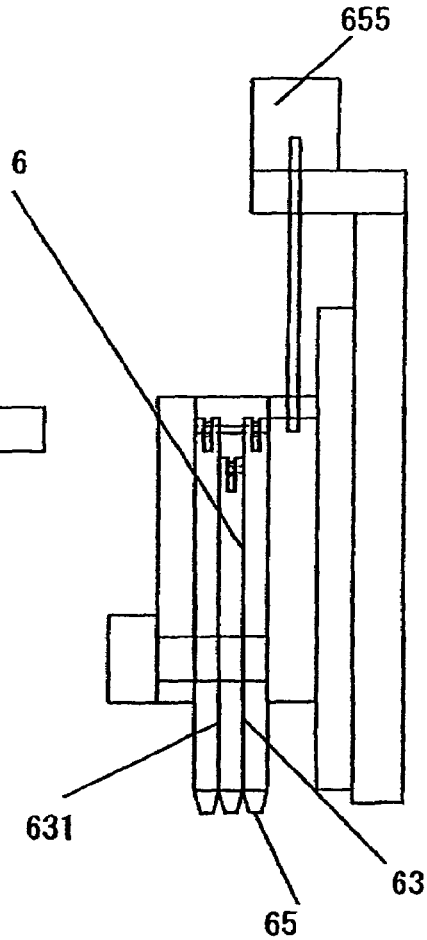
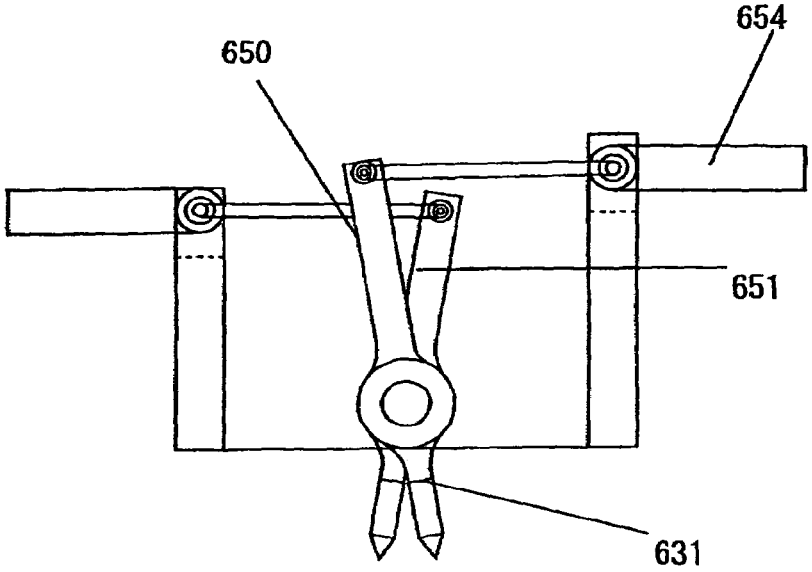
FIG.11-C

FIG.12-A-1
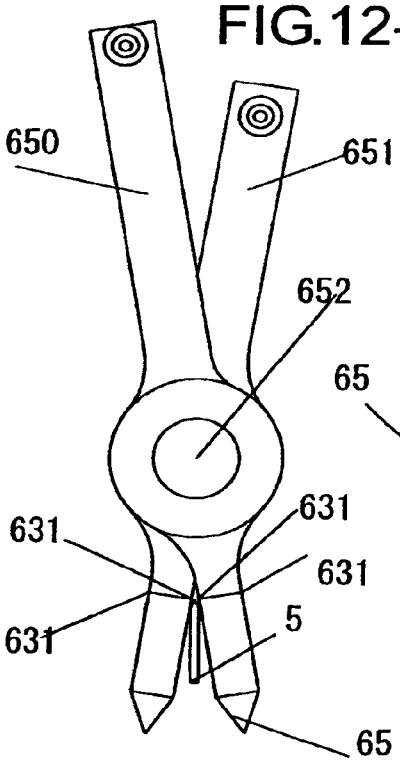
FIG.12-A-2
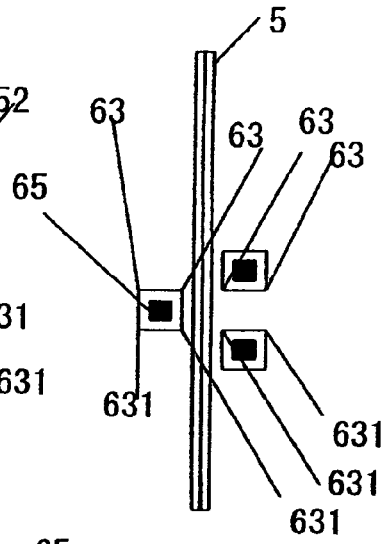
FIG.12-A-3
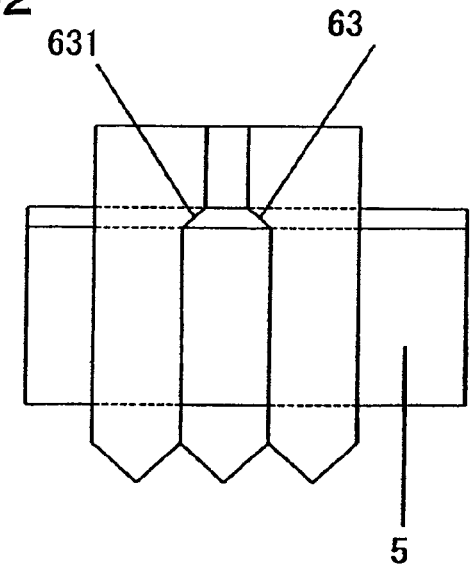
FIG.12-B-1
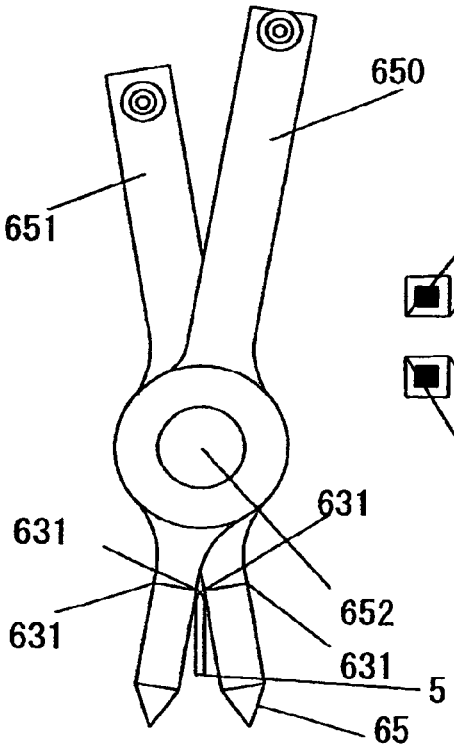
FIG.12-B-2
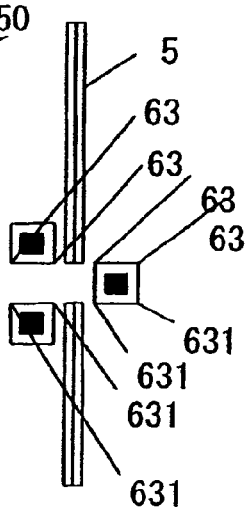
FIG.12-B-3
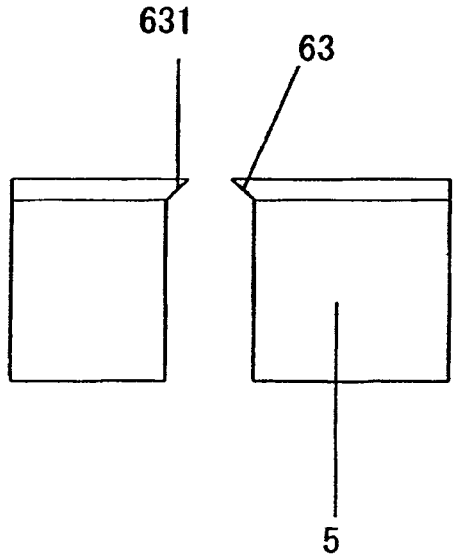

FIG.13-A
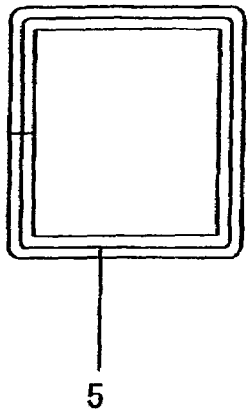
FIG.13-B
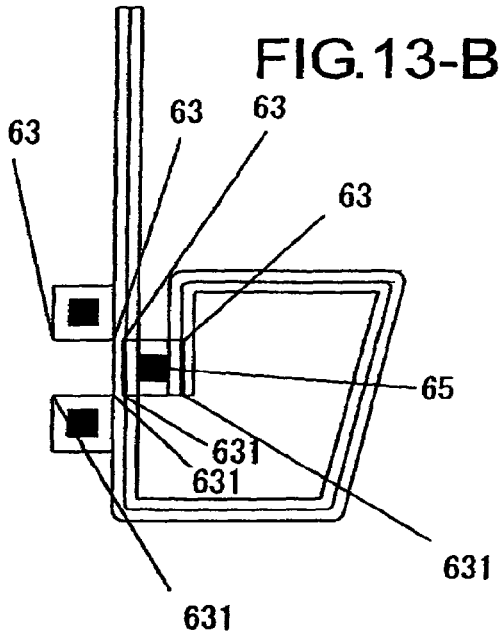
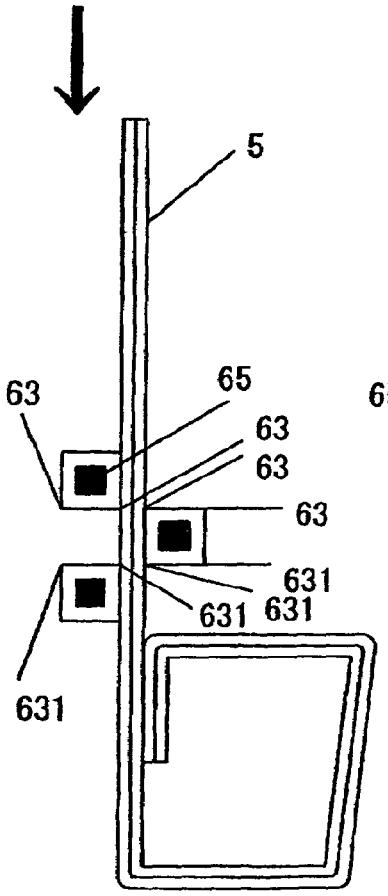
FIG.13-C
FIG.13-D
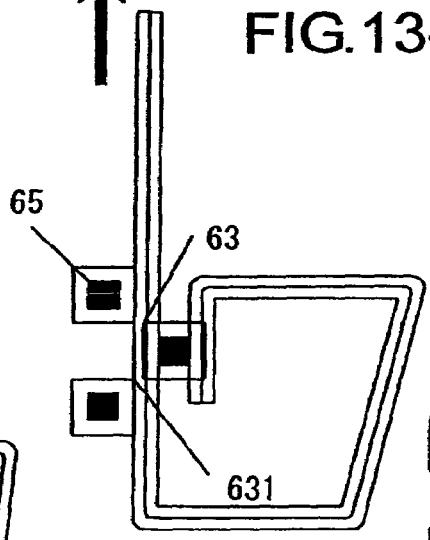
FIG.13-E
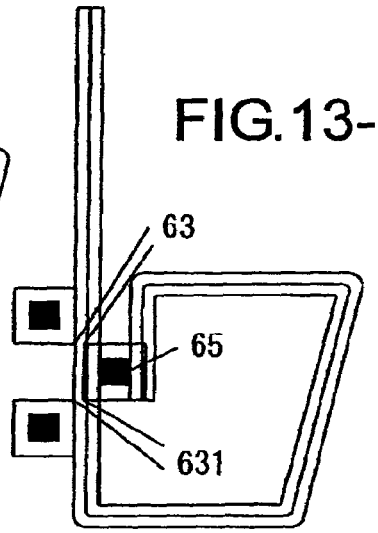

AUTOMATIC BENDING MACHINE FOR MANUFACTURING OF STEEL RULE CUTTING DIES

BACKGROUND OF THE INVENTION

Field of the Invention

The present invention relates to an automatic bending machine for manufacturing of steel rule cutting dies which are used to form a prescribed cut or rule on a cardboard, a corrugated board, or the like, in manufacturing a paper container, a corrugated board container, or the like, and particularly to an automatic bending machine for carrying out bending, cutting, and the like, of a strip blade material constituting a steel rule cutting die.

Since, in 1988, Suchiro Mizukawa published the world-first automatic bending machine for manufacturing of steel rule cutting dies (provided with a trade name of BBS-101), the automatic bending machine of this type has been greatly improved. For example, in the following patent documents 1 and 2, an automatic bending machine for carrying out bending, cutting, and the like, of a strip blade material constituting a steel rule cutting die is disclosed, respectively.

Patent documents 1: U.S. Pat. No. 6,629,442

Patent documents 2: U.S. Pat. No. 5,787,750

Patent documents 3: Japanese Patent Publication No. JP/11-347828A/1999

Patent documents 4: Japanese Patent Publication No. JP/2001-314932A

The bending tool of U.S. Pat. No. 6,158,264 by Suchiro Mizukawa was a bending tool which is concentrically operated, as shown in FIG. 9-A, thus the maximum bending angle was 90 degrees. The bending tool can actually be turned by an angle of over 90 degrees, however, because a springback occurs with the strip blade material 5 bent, the maximum bending angle was limited to 90 degrees. This mechanism is simple, providing a sturdy tooling, thus being high in reliability. In addition, the simple construction requires no extra motor or cylinder. This invention includes no mechanism for cutting both ends of the strip blade material.

Conventionally, bending tools which have a bending capacity of more than 90 degrees have been available; for example, those as disclosed in U.S. Pat. No. 4,627,255 and U.S. Pat. No. 5,787,750. With these tools, two bending members are alternately moved in a vertical direction on both sides of the strip blade material 5. There is the possibility that the two bending members may be struck against the bottom of the workpiece, resulting in jamming, when they are moved upward. In addition, the number of bending members provided is two rather than one, which takes an increased working time. Because the bending members are only inserted, there was the need for introducing a synchronizing mechanism in order to eliminate the possibility of damaging them. In addition, an extra mechanism for vertically moving the bending members is required. (Referring to the construction as shown in FIG. 9-B)

With the cutting mechanism as disclosed in U.S. Pat. No. 5,787,750, both ends of the workpiece are straight-cut or miter-cut prior to the bending by the bending mechanism. This method will not provide accuracy of the length. The invention of U.S. Pat. No. 6,629,442 uses the cutting mechanism as disclosed in U.S. Pat. No. 6,324,953. However, the type of cutting is limited to straight cutting. FIG. 10-A illustrates the cutting mechanism as disclosed in U.S. Pat. No. 6,227,026, which uses two scissors-like movable tools 6 to cut only the top portion of the blade material at both ends. The body portion thereof is separately cut by means of a bridge cutting tool. In other words, a two-stage cutting is carried out.

FIGS. 10-B and FIG. 10-C illustrate the cutting mechanism as disclosed in U.S. Pat. No. 6,324,953, which eliminates the need for two-stage cutting, but cutting is performed on both sides of the stationary blade 61, which requires a separate cylinder for displacement between sides of the blade 61.

When any of these cutting mechanisms is used to cut a blade material having an enclosed rectangular geometry as shown in FIG. 13-A in the manner as illustrated in FIG. 13-B, "two-leaf cutting" is caused, resulting in the workpiece as a product being damaged.

The bending mechanism as disclosed in U.S. Pat. No. 6,629,442 provides a complex construction in which two bending tools are incorporated in a double gear, one of them being turned in a clockwise direction by the gear which is vertically moved by a separate motor, while the other being turned counterclockwise.

SUMMARY OF THE INVENTION

The most important purpose of the present invention is to provide a bending tool which is sturdy and having precision, having a capability of bending the workpiece to an angle as deep as over 90 degrees, without the need for using any extra device, such as motor, cylinder, and the like.

The present invention provides an automatic bending machine for automatically bending a strip blade material, wherein the automatic bending machine intermittently feeds a strip blade material 5 through a nozzle 3 until the strip blade material 5 is jutted out from a nozzle gate 31 at the end of the nozzle 3, and causes a CW-direction bending tool 4 or a CCW-direction bending tool 40 to be turned in a clockwise direction or a counterclockwise direction, respectively, to strike the strip blade material 5 for bending it; the CW-direction bending tool 4 and the CCW-direction bending tool 40 being provided with a bending tool support 42 extending at right angles thereto and having a concentric hole 41, at the top and bottom of the CW-direction bending tool 4 and the CCW-direction bending tool 40, respectively; the CW-direction bending tool 4 and the CCW-direction bending tool 40 being superposed one upon the other; a nozzle column 32 or a reinforcing rod 1021 provided on the top of the nozzle 3, penetrating through the concentric hole 41; and a protrusion 22 being provided on the top of a lower belt wheel 21 turned under the control of a computer, being in contact with the bending tool support 42. More specifically, when the lower belt wheel 21 is turned, the protrusion 22 thereon is also turned. And, when the protrusion 22 is turned clockwise or counterclockwise, it forces the CW-direction bending tool 4 or the CCW-direction bending tool 40 to strike the strip blade material 5 for bending it in a CW or CCW direction, respectively.

The automatic bending machine for automatically bending a strip blade material of the present invention may be configured such that an upper belt wheel 2 is provided in a lower machine cabinet 101 extending from a machine cabinet 1 in concentricity with the nozzle column 32 or the reinforcing rod 1021 independently of the nozzle column 32 or the reinforcing rod 1021.

Further, the automatic bending machine for automatically bending a strip blade material of the present invention may be configured such that the nozzle column 32 is connected to an upper reinforcing tube 321 provided in an upper machine cabinet 102 extending from a machine cabinet 1 for reinforcement, in order to allow the nozzle 3 to withstand the striking impact applied by the CW-direction bending tool 4 or the CCW-direction bending tool 40.

In addition, the automatic bending machine for automatically bending a strip blade material of the present invention may be configured such that a magnet 221 or a ball plunger 222 is provided for a protrusion 22 or a groove stopper 44, or a spring 223 is provided for a bending tool support 42, in order to rapidly return the CW bending tool 4 or the CCW bending tool 40 from the working position to the retract one.

Further, the automatic bending machine for automatically bending a strip blade material of the present invention may be configured such that the nozzle column 32 is connected to a reinforcing tube 321 provided in the upper machine cabinet 102 extending from the machine cabinet 1 by means of a screw. By providing such a configuration, removing the reinforcing tubes 321 will allow the nozzle 3, the CW-direction bending tools 4, the CCW-direction bending tools 40, and the like to be pulled forward from the machine cabinet 1 together with the nozzle supports 11, facilitating the tooling replacement.

The cutting mechanism is formed in the scissors-like shape as shown in FIG. 11-A-1, and is capable of cutting a strip blade material 5 as high as 23.8 mm at once.

In addition, the setup method of the present invention will allow a workpiece having an enclosed rectangular geometry as shown in FIG. 13-A to be cut without "two-leaf cutting" being caused.

The present invention has the following effects.

Because, with the present invention, two different bending tools are provided as described above, bending by an angle of over 90 degrees can be performed.

Because, with the present invention, two different bending tools are provided as described above, there is no need for the bending tool being vertically moved to the opposite side, thus tool jamming will not occur.

Because, with the present invention, two different bending tools are provided as described above, there is no need for the bending tool being vertically moved to the opposite side, thus the working time can be saved. In addition, the CW-direction bending tool 4 or the CCW-direction bending tool 40 turned for striking can be retracted with the magnet 221 or the spring 223 for the subsequent bending.

Because, with the present invention, two different bending tools are provided as an integral part, as described above, the rigidity of the CW-direction bending tool 4 and the CCW-direction bending tool 40 can be maintained, which assures bending with high accuracy. The "integral part" means that the tool is fixed with screws, or the like, rather than being temporality inserted.

Because, with the present invention, no extra motor and cylinder are required as described above, the control system can be manufactured at a lower cost. In addition, the problems which would be caused by the extra motor and cylinder can be eliminated.

Because, with the present invention, the nozzle column 32 may be connected with the reinforcing tube 321 in the upper machine cabinet 102 as described above, the nozzle 3 can be adapted to withstand the striking impact applied by the CW-direction bending tool 4 or the CCW-direction bending tool 40.

With the present invention, the nozzle column 32 may be connected to a reinforcing tube 321 provided in the upper machine cabinet 102 extending from the machine cabinet 1 by means of a screw, as described above, thus by providing such a configuration, removing the reinforcing tubes 321 will allow the nozzle 3, the CW-direction bending tools 4, the CCW-direction bending tools 40, and the like to be pulled forward from the machine cabinet 1 together with the nozzle supports 11, facilitating the tooling replacement. For example, the tooling for blades of 2 P with a thickness of 0.72 mm can be easily replaced with that for blades of 3 P with a thickness of 1.08 mm.

In addition, the cutting tool of the present invention is capable of cutting a strip blade material 5 as high as 23.8 mm at once.

In addition, the setup method of the present invention will allow a workpiece having an enclosed rectangular geometry as shown in FIG. 13-A to be cut without "two-leaf cutting" being caused.

BRIEF DESCRIPTION OF THE DRAWINGS

FIGS. 4-A, FIG. 4-B, and FIG. 4-C are plan views illustrating an embodiment of the process of bending a strip blade material of the present invention;

FIG. 5-A is a perspective view illustrating a second embodiment of the automatic bending machine of the present invention;

FIG. 5-B is a sectional plan view illustrating the configuration of the guide groove and guide protrusion in the above-mentioned second embodiment;

FIGS. 6-A, FIG. 6-B, and FIG. 6-C are perspective views illustrating second, third, and fourth types of bending tool puller-back element used with the present invention, respectively;

FIG. 7-A is a perspective view illustrating a second embodiment of the bending tool of the present invention;

FIG. 7-B is a perspective view illustrating a third embodiment of the bending tool of the present invention;

FIG. 8-A is a sectional side view of a third embodiment of the automatic bending machine of the present invention (drawing of the lower half section of the apparatus being omitted);

FIG. 8-B is a partially enlarged sectional side view of a modification of the above-mentioned third embodiment of the automatic bending machine of the present invention;

FIG. 9-A and FIG. 9-B are plan views of bending tools of the prior art;

FIG. 10-A is a front view of a cutting tool of the prior art;

FIG. 10-B is a perspective view of anther cutting tool of the prior art;

FIG. 10-C is a front view of the same cutting tool as FIG. 10-B;

FIG. 11-A is a front view of an embodiment of the cutting unit of the present invention, the cutting tool components being in one position, respectively;

FIG. 11-B is a side view of the cutting unit;

FIG. 11-C is a front view of the cutting unit, the cutting tool components being in the other position, respectively;

FIG. 12-A-1 is a front view of an embodiment of the cutting tool of the present invention, the components thereof being in one position, respectively;

FIG. 12-A-2 is a sectional plan view of the cutting tool, the components thereof being in one position, respectively, and the workpiece before being cut;

FIG. 12-A-3 is a sectional front view of the cutting tool, the components thereof being in one position, respectively, and the workpiece before being cut;

FIG. 12-B-1 is a front view of the cutting tool, the components thereof being in the other position, respectively;

FIG. 12-B-2 is a sectional plan view of the cutting tool, the components thereof being in the other position, respectively, and the workpiece after being cut;

FIG. 12-B-3 is a sectional front view of the workpiece after being cut;

FIG. 13-A is a sectional plan view of a workpiece having an enclosed rectangular geometry.

FIG. 13-B is a sectional plan view illustrating how the above-mentioned workpiece is cut with the cutting tool of the present invention;

FIG. 13-C illustrates a first step comprised in the method of the present invention for preventing the occurrence of "two-leaf cutting" with an enclosed rectangular geometry of workpiece;

FIG. 13-D illustrates a second step in the method of the present invention for preventing the occurrence of "two-leaf cutting" with an enclosed rectangular geometry of workpiece;

FIG. 13-E illustrates a third step in the method of the present invention for preventing the occurrence of "two-leaf cutting" with an enclosed rectangular geometry of workpiece.

DETAILED DESCRIPTION OF THE INVENTION

Hereinbelow, exemplary embodiments of the present invention will be described with reference to the attached drawings.

Figure 1:
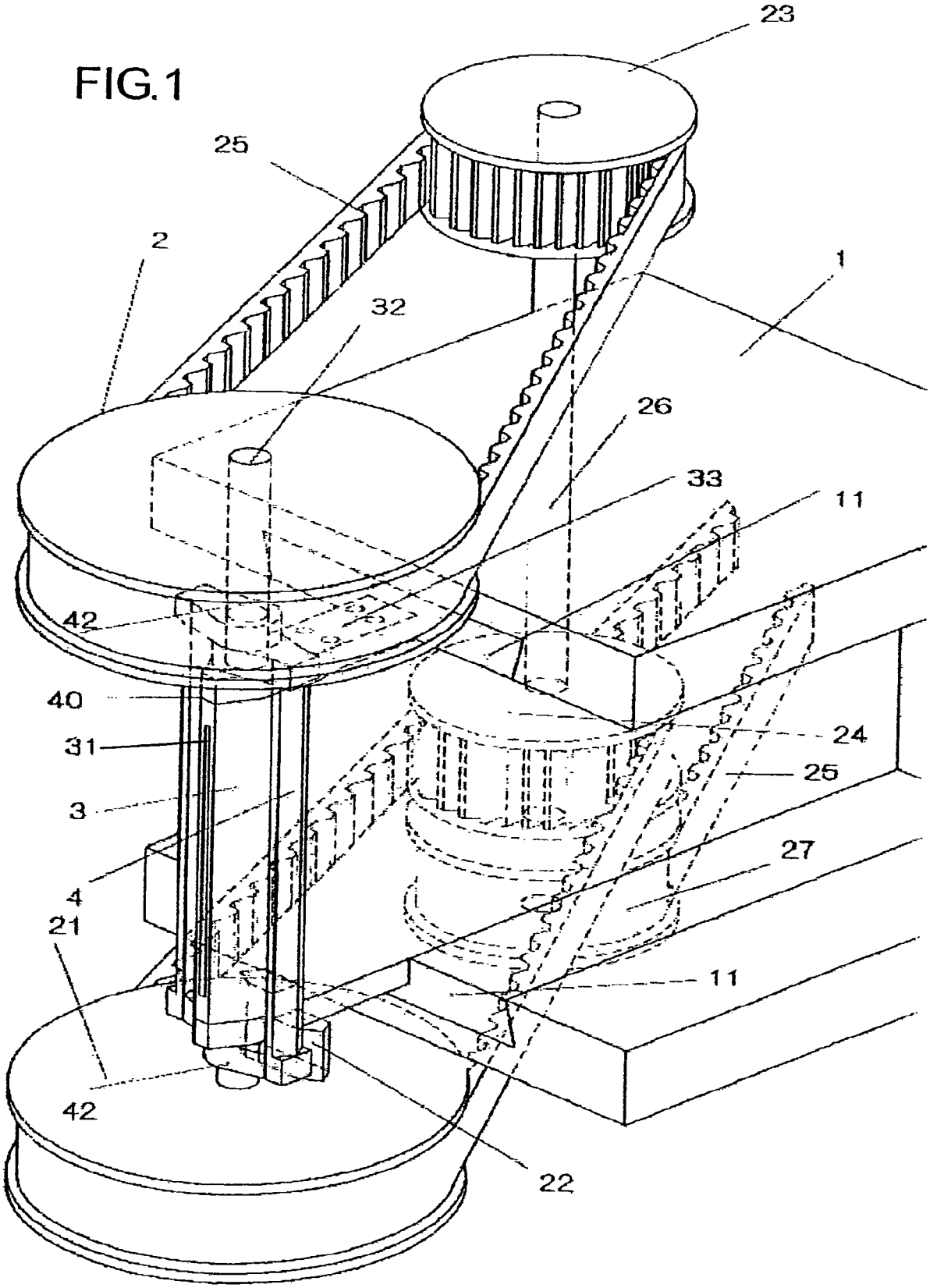
FIG. 1 is a perspective view illustrating a first embodiment of the automatic bending machine of the present invention.
Figure 2:
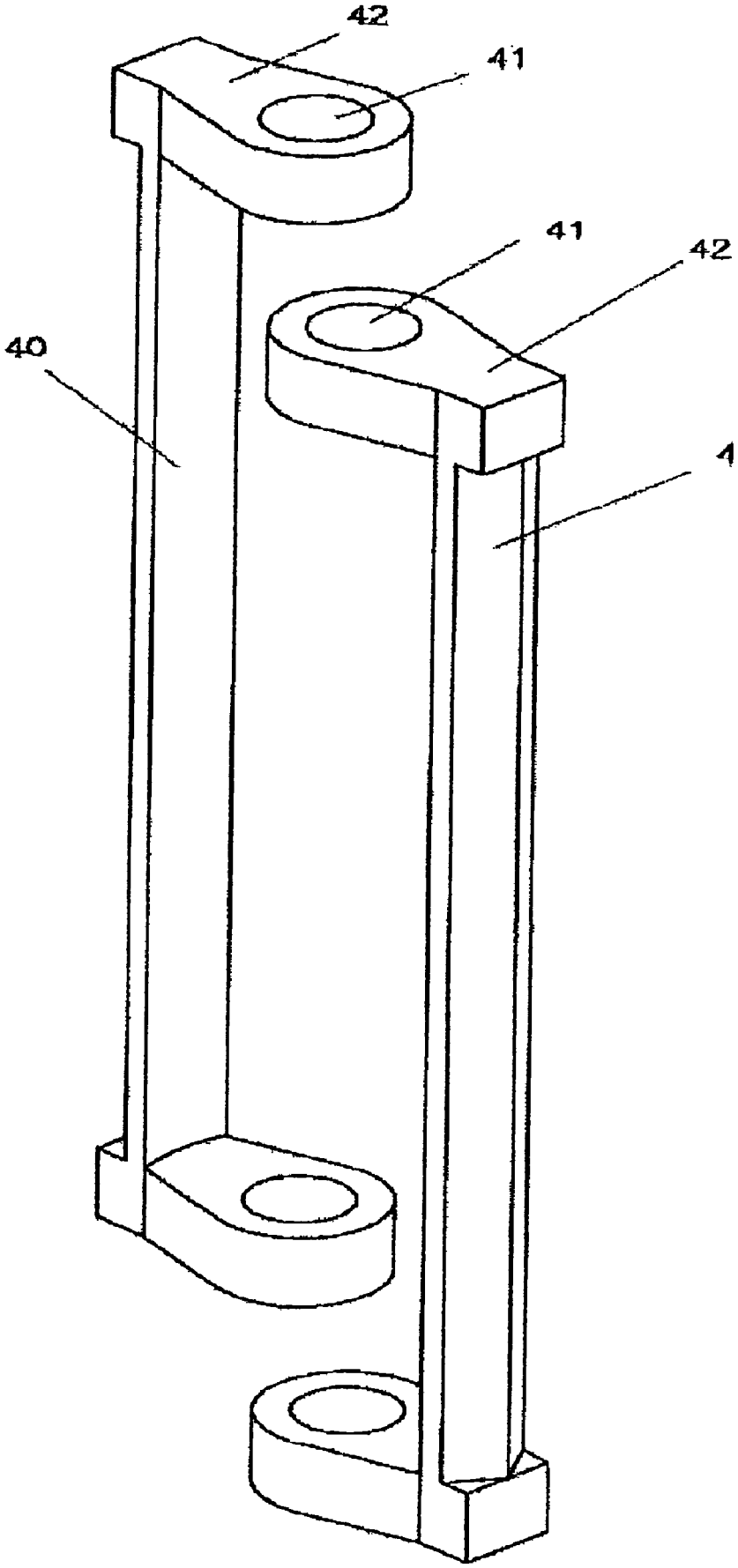
FIG. 2 is a perspective view illustrating a first embodiment of the bending tool of the present invention.
Figure 3:
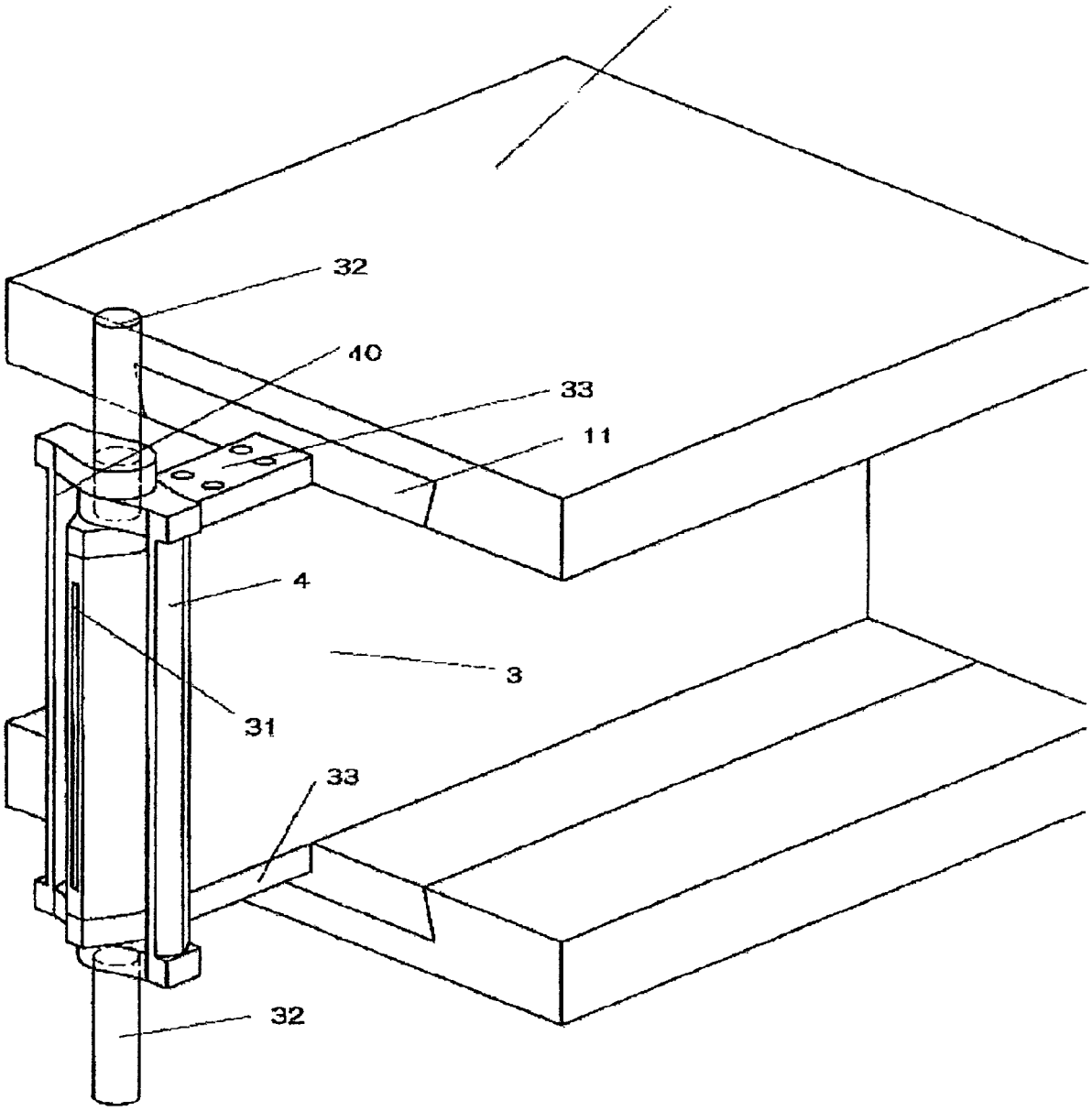
FIG. 3 is a perspective view illustrating a combination of the nozzle and bending tool of the present invention.

FIG. 1 is a perspective view illustrating a first embodiment of the automatic bending machine for manufacturing of steel rule cutting dies of the present invention. A nozzle 3 for guiding a strip blade material 5 which is intermittently fed has nozzle supports 11 at the top and bottom thereof that are inserted into a machine cabinet 1. At the tip of the nozzle 3, a nozzle gate 31 from which the strip blade material 5 juts out is provided. At the top and bottom of the nozzle 3, a nozzle column 32 which penetrates through a concentric hole 41 in a CW-direction bending tool 4, and the same in a CCW-direction bending tool 40 is provided. In FIG. 3, the relationship among the nozzle 3, the CW-direction bending tool 4, and the CCW-direction bending tool 40 is illustrated in detail. In addition, FIG. 2 shows the CW-direction bending tool 4 and the CCW-direction bending tool 40 in detail. The CW-direction bending tool 4 or the CCW-direction bending tool 40 is turned around the nozzle gate 31 to strike the side of the strip blade material 5 to bend it. In the present invention, two different bending tools which are turned in a clockwise or counterclockwise direction when viewed from the top, for working (in other words), the CW-direction bending tool 4 and the CCW-direction bending tool 40, are provided. As can be seen from FIG. 2, these two tools have the same geometry like a vertical trough, a bending tool support 42 extending at right angles at the top and bottom thereof. In the bending tool support 42, a concentric hole 41 through which the nozzle column 32 penetrates is provided. The CW-direction bending tool 4 and CCW-direction bending tool 40 are superposed one upon the other, and as shown in FIG. 3, are penetrated by the nozzle column 32 to be fixed to the nozzle 3. When viewed from the front, the CCW-direction bending tool 40 at the left side is superposed on the CW-direction bending tool 4 at the right side. To assemble in such a configuration, the nozzle column 32 is inserted into the CW-direction bending tool 4 and the CCW-direction bending tool 40 placed on a column base 33, and then fixed with a screw to the column base 33 on the top and bottom of the nozzle 3, respectively. The nozzle 3 is inserted into the machine cabinet 1 by means of the integrated nozzle supports 11 at the top and bottom of the nozzle 3. The nozzle column 32 is further inserted into the upper belt wheel 2 or the lower belt wheel 21 which is turned by the timing belt 25. The timing belt 25 connects between the upper and lower synchronous belt wheel 27 and the upper belt wheel 2 or the lower belt wheel 21. The upper and lower synchronous belt wheel 27 is connected to the synchronous lower belt wheel 24 and the upper and lower synchronous belt wheel 27 by the synchronous shaft 26. The upper and lower synchronous belt wheel 27 is connected to a turning motor (not shown) by the timing belt 25. When the turning motor is run, the force is transmitted to the upper and lower synchronous belt wheel 27 to turn the upper belt wheel 2 and the lower belt wheel 21. On the back of the upper belt wheel 2 and the lower belt wheel 21, a protrusion 22 is provided, and when the motor is run, the protrusion 22 strikes the bending tool support 42.

FIG. 4-A, FIG. 4-B, and FIG. 4-C illustrate the process of bending the strip blade material 5 by the tool of the present invention. FIG. 4-A shows the initial state, the CW-direction bending tool 4 and the CCW-direction bending tool 40 being in the home position. When the protrusion 22 is turned counter clockwise (CCW), the CCW-direction bending tool 40 is struck against the strip blade material 5 as shown in FIG. 4-B. When the protrusion 22 is further turned CCW, the CCW-direction bending tool 40 and the nozzle gate 31 bend the strip blade material 5 by an angle of over 90 degrees as shown in FIG. 4-C. As a result of such a configuration, the strip blade material 5 can be bent to an angle close to 130 degrees, as compared to 90 degrees with a construction as shown in FIG. 9-A.

FIG. 5-A shows a second embodiment of the automatic bending machine of the present invention. In this embodiment, a guide protrusion 43 is provided for each of the CW-direction bending tool 4 and the CCW-direction bending tool 40 in place of the protrusion 22 in the above-described embodiment, while the upper belt wheel 2 and the lower belt wheel 21 are provided with a guide groove 23. At both ends of the guide groove 23, a groove stopper 44 which butts against the guide protrusion 43 is provided. Thereby, the same effect as that which can be obtained by the above-described embodiment is given. However, even if the guide groove 23 is not provided, the CW-direction bending tool 4 and the CCW-direction bending tool 40 can be turned, thus providing a guide groove is not a requisite for the present embodiment, and instead of the groove stopper 44, a protrusion 22 may be provided.

FIG. 8-A is a sectional side view of a third embodiment of the automatic bending machine of the present invention (drawing and description of the lower half section of the apparatus being omitted). With the present embodiment, the nozzle column 32 on the nozzle 3 is free from the load imposed by the timing belt in driving. Specifically, in order to make the nozzle column 32 free from the transmission of the force through the upper belt wheel 2 and the protrusion 22, the belt wheel 2 and the protrusion 22 are provided in the lower machine cabinet 101 extending from the machine cabinet 1. The belt wheel 2 includes a hollow belt wheel 210 which is disposed concentrically with the nozzle column 32, and a tubular connecting element 212, being turned by the timing belt. The lower portion of the belt wheel 2 includes a portion which turns with a needle bearing 211, and the bottom part on which the protrusion 22 is mounted. Thereby, the nozzle column 32 is free from the load imposed by the timing belt drive.

In addition, the nozzle column 32 on the top of the nozzle 3 may be reinforced because it is subjected to the bending pressure by the CW-direction bending tool 4 or the CCW-direction bending tool 40. To do this, a reinforcing tube 321 penetrating through the upper machine cabinet 102 extending from the machine cabinet 1 is provided concentrically with the nozzle column 32, and the nozzle column 32 is fixed thereto by means of a screw at the end. Thereby, the back of the nozzle 3 is inserted into the machine cabinet 1, and the top and bottom thereof are fixed to the reinforcing tube 321 in the present embodiment, which allows the nozzle 3 to withstand the striking impact applied by the CW-direction bending tool 4 or the CCW-direction bending tool 40. In FIG. 8-A, the CW-direction bending tool 4 is omitted from being shown for ease of understanding.

With the protrusion 22 as shown in FIG. 4-A, FIG. 4-B, and FIG. 4-C, a strong magnet 221 is embedded in the area where the protrusion 22 is struck against the bending tool support 42. The purpose of imbedding of the magnet 221 is this: When the strip blade material 5 is to be bent to form a desired circular arc, it is first fed by 1 mm, and struck once by the CW-direction bending tool 4 or the CCW-direction bending tool 40, then the CW-direction bending tool 4 or the CCW-direction bending tool 40 is once reversely turned to the retract position before the strip blade material 5 is fed by another 1 mm. Then, the strip blade material 5 is fed by another 1 mm, and is struck the second time by CW-direction bending tool 4 or the CCW-direction bending tool 40. A desired circular arc is thus formed by repeating this cycle, and this arc forming method is called the polyline method. This method involves reverse turning the CW-direction bending tool 4 or the CCW-direction bending tool 40 to the retract position. Therefore, a magnet is used, and as the magnet, a neodymium one is optimum. In the position as shown in FIG. 4-A, the CW-direction bending tool 4 and the CCW-direction bending tool 40 are attracted to the protrusion 22. In the position as shown in FIG. 4-B, the CW-direction bending tool 4 is butted against the side wall of the nozzle 3, being left there, and the CCW-direction bending tool 40 is further turned to bend the strip blade material 5 as shown in FIG. 4-C, then the protrusion 22 being reversely turned to the retract position. Even during that reverse turning, the CCW-direction bending tool 40 can be returned to the retract position, being attracted and held by the magnet 221. This description of the bending operation is also applicable when the CW-direction bending tool 4 is used for carrying out a CW-direction bending.

In the present invention, the puller-back element for the CW-direction bending tool 4 and the CCW-direction bending tool 40 is not particularly limited to a magnet, and any type thereof may be adopted, provided that the puller-back element can return the CW-direction bending tool 4 or the CCW-direction bending tool 40 to the retract position when the protrusion 22 is reversely turned. Examples of other types of puller-back element are shown in FIG. 6-A, FIG. 6-B, and FIG. 6-C. In FIG. 6-A, a ball plunger 222 is embedded in the protrusion 22 instead of the above-mentioned magnet. In FIG. 6-B, one end of the spring 223 is connected to the bending tool support 42, and the other end is to the nozzle support 11. In this case, in bending, the torque for the CW-direction bending tool 4 or the CCW-direction bending tool 40 overcomes the force of the spring 223, while, in reverse turning, the CW-direction bending tool 4 or the CCW-direction bending tool 40 is pulled back by the force of the spring 223 extended. In FIG. 6-C, both springs 223 are connected to the nozzle support 11. The effect of these other types of puller-back element is equivalent to that of the magnet 221.

With the embodiment as shown in FIG. 8-A (drawing and description of the lower half section of the apparatus being omitted), replacement of the tooling can be performed with ease. Generally, automatic bending machines bend the blade of 1.5 P with a thickness of 0.5 mm, 2 P with a thickness of 0.72 mm, 3 P with a thickness of 1.08 mm, or 4 P with a thickness of 1.44 mm. Thus, when the strip blade material 5 having a different thickness is to be bent, the nozzle 3, the CW-direction bending tool 4, and the CCW-direction bending tool 40 must be replaced with those for the different thickness. However, with the embodiment as shown in FIG. 1, the replacement operation takes so much time as would render it impracticable. On the contrary, with the embodiment as shown in FIG. 8-A, it is only required that the handwheel 322 for the reinforcing tube 321 be turned to disengage the screw at the bottom of the reinforcing tube 321 from the nozzle column 32; the nozzle 3, the CW-direction bending tool 4, and the CW-direction bending tool 40 be pulled forward to be removed; the desired tooling be inserted; and the reinforcing tube 321 be again fixed to the nozzle column 32 (description of the lower half section of the apparatus being omitted).

In the present invention, the CW-direction bending tool 4 and the CCW-direction bending tool 40 are not limited to those as shown in FIG. 2, and for example, those as shown in FIG. 7-A may be used. The CW-direction bending tool 4 and the CCW-direction bending tool 40 as shown in FIG. 7-A each consist of three components which are assembled using screws 45, thus rendering the manufacture easier. In this case, the need for the column base 33 as shown in FIG. 3 is eliminated, and the nozzle column 32 can be directly mounted into the nozzle 3. Then, after the bending tool support 42 being fitted to the nozzle column 32, the CW-direction bending tool 4 and the CCW-direction bending tool 40 are finally fixed using the screws 45, respectively. The CCW-direction bending tool 40 and the CW-direction bending tool 4 as shown in FIG. 7-A are mutually different in geometry, the CCW-direction bending tool 40 being accommodated in the inside of the CW-direction bending tool 4. Thus, the CW-direction bending tool 4 and the CCW-direction bending tool 40 need not always have the same geometry. FIG. 7-B shows a CW-direction bending tool 4 having another geometry. With this configuration, when the CW-direction bending tool 4 is worn, only the CW-direction bending tool 4 need be replaced with new one, with the bending tool support 42 being left mounted. This description is also applicable to the CCW-direction bending tool 40.

FIG. 8-B is a partially enlarged sectional side view of a modification of the embodiment as shown in FIG. 8-A. In this modification, a reinforcing rod 1021 is used in place of the reinforcing tube 321 in FIG. 8-A. The reinforcing rod 1021 is threaded at the end, and is fixed to an insertion hole 3211 which is provided in the top of the nozzle 3. In this case, there is no need for the nozzle column 32, and the end of the reinforcing rod 1021 penetrates through the concentric hole 41 in the respective bending tools to be fixed to the insertion hole 3211 by means of the screw.

In the embodiment as shown in FIG. 8-A (drawing of the lower half section of the apparatus being omitted), the respective protrusions 22 strike the respective bending tool supports 42, being synchronized through the upper belt wheel 2 and the lower belt wheel 21, however, both upper and lower belt wheels are not always required. Only either of them may be provided. However, providing both upper and lower belt wheels eliminates the uneven distribution of the force on the strip blade material 5, which allows the size of the CW-direction bending tool 4 and the CCW-direction bending tool 40 to be reduced.

Figure 14:
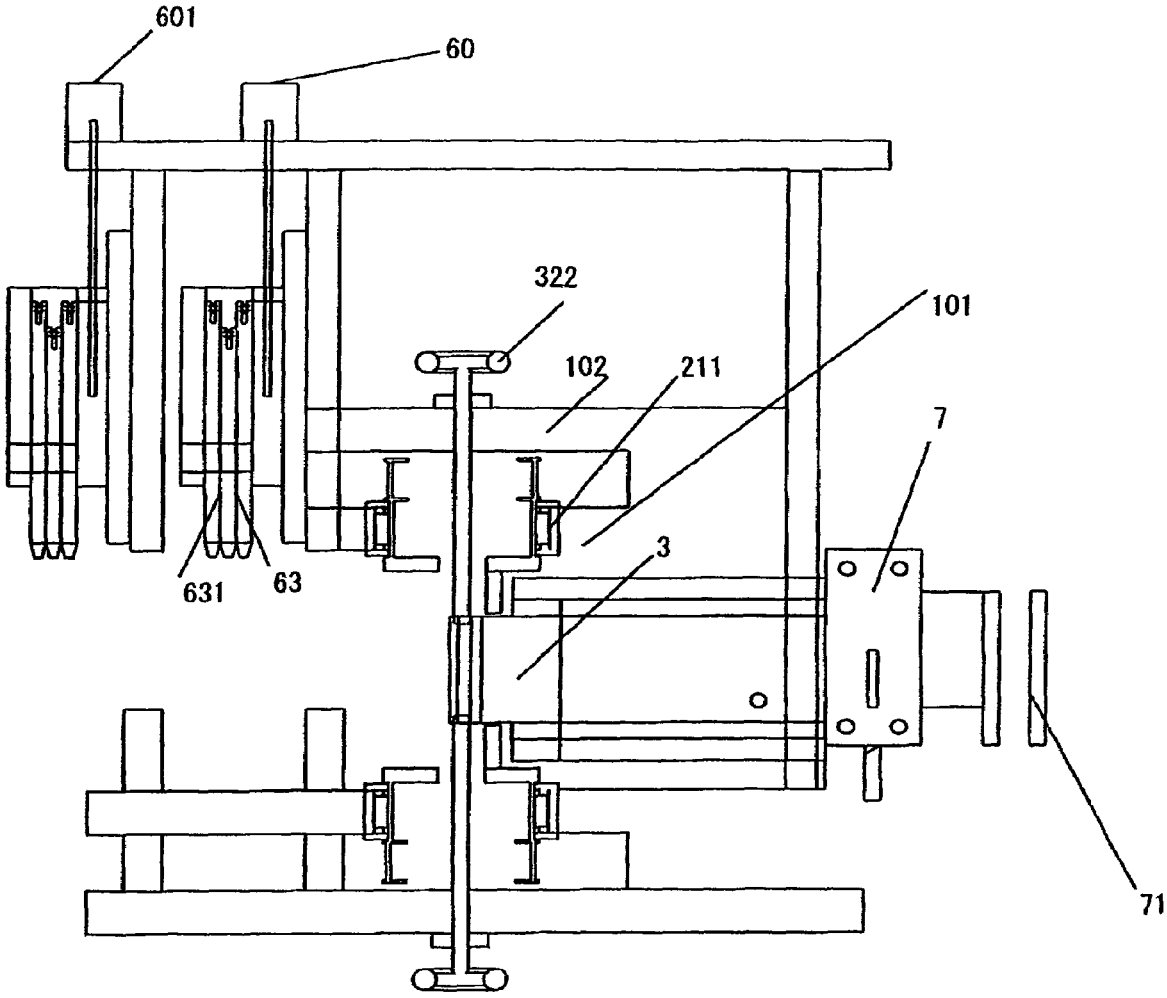
FIG. 14 is a side view illustrating an embodiment of the automatic bending machine including the both-end cutting apparatus of the present invention in which a miter cutting unit and a straight cutting unit are additionally provided ahead of the bending apparatus.

FIG. 14 shows an embodiment of the automatic bending machine including the both-end cutting apparatus of the present invention in which a miter cutting unit 60 and a straight cutting unit 601 are additionally provided ahead of the bending apparatus. As shown in FIG. 11-A, FIG. 11-B, and FIG. 11-C, the cutting tool 6 is made up of a set of three scissors-like cutting tool components. More specifically, the cutting tool 6 consists of two higher-profile cutting tool components 650 on both sides, a lower-profile cutting tool component 651 in the middle, and a through pin 652 which penetrates through these three cutting tool components. The three cutting tool components are connected to mini-cylinders 654 through a bar 653 at the top thereof, respectively. The miter cutting unit 60 is vertically moved by an elevating motor 655. When the strip blade material 5 is to be cut, the miter cutting unit 60 is lowered by the elevating motor 655 to the position where the strip blade material 5 can be cut, being pinched by the above-mentioned three cutting tool components. Then, the mini-cylinders 654 are operated, the state as shown in FIG. 11-A being changed into that as shown in FIG. 11-C, the strip blade material 5 being cut.

FIG. 12-A-1, FIG. 12-A-2, FIG. 12-A-3, FIG. 12-B-1, FIG. 12-B-2, and FIG. 12-B-3 illustrate how the strip blade material 5 is cut by the miter cutting unit 60. In this case, the three cutting tool components are provided with different die geometries (in other words), a workpiece front end miter cutting edge 63 and a workpiece rear end miter cutting edge 631 as shown in FIG. 12-A-1, FIG. 12-A-2, FIG. 12-A-3.

The respective higher-profile cutting tool components 650 and lower-profile cutting tool component 651 for miter geometry cutting have a cutting edge on both sides. Therefore, the strip blade material 5 can be pinched with the higher-profile cutting tool components 650 and the lower-profile cutting tool component 651 being positioned as shown in FIG. 12-B-1 and 12-B-2. Then, the positions of the higher-profile cutting tool components 650 and the lower-profile cutting tool component 651 can be changed into those as shown in FIG. 12-A-1 and FIG. 12-A-2 to cut the strip blade material 5. In other words, cutting can be carried out regardless of whether the higher-profile cutting tool components 650 and the lower-profile cutting tool component 651 are positioned as shown in FIG. 12-A-1 and FIG. 12-A-2, or in FIG. 12-B-1 and 12-B-2.

Especially when the strip blade material has a geometry of an enclosed rectangle as shown in FIG. 13-A, the conventional cutting tool as shown in FIG. 10-B causes tool jamming, thus the bending steps may have to be reversed. Further, depending upon the geometry of the strip blade material, occurrence of tool jamming cannot be avoided, even if the bending steps are reversed. With the present invention, such a problem will not be caused.

For a rectangular geometry as shown in FIG. 13-B, if the cutting tool 6 is lowered such that the higher-profile cutting tool components 650 and the lower-profile cutting tool component 651 are positioned as shown in FIG. 12-B-1 and FIG. 12-B-2, tool jamming will not be caused, because the two higher-profile cutting tool components 650 are not positioned on the rectangular geometry side. However, the one cutting tool component 651 must be inserted between the overlapped portions of the strip blade material 5. Selection of the positions of the higher-profile cutting tool components 650 and the lower-profile cutting tool component 651 as shown in either FIG. 12-A-1 and FIG. 12-A-2, or FIG. 12-B-1 and FIG. 12-B-2, depending upon the geometry of the strip blade material 5, will prevent tool jamming.

FIG. 13-C, 13-D, and 13-E illustrate the respective steps included in the setup method of the present invention for preventing the occurrence of "two-leaf cutting" in the end cutting of a workpiece having an enclosed rectangular geometry. Even if the higher-profile cutting tool components 650 and the lower-profile cutting tool component 651 are positioned as shown in FIG. 13-B, but when the cutting tool tip 65 lowered is not inserted between the overlapped portions of the strip blade material 5, the "two-leaf cutting" will be caused. Thus, before the cutting tool tip 65 is lowered, a spacing must generally be provided between the overlapped portions by using fingers so as to allow the cutting tool tip 65 of the cutting tool component 651 to be inserted between the overlapped portions. Then, to eliminate this difficulty, after the three cutting tool components being positioned such that the two higher-profile cutting tool components 650 are positioned on the side opposite to the rectangular geometry side, the strip blade material 5 is once advanced to a position where "two-leaf cutting" will not occur, as shown in FIG. 13-C, and then the cutting tool 6 is lowered. The cutting tool tip 65 of the cutting tool component 651 is lowered to a level of the same as or under that of the top edge of the strip blade material 5. Then the strip blade material 5 is retracted (FIG. 13-D). Finally, the strip blade material 5 is retracted by the same amount as that of the advance from the desired position (FIG. 13-E). This setup method of the present invention is applicable to the conventional cutting tool as shown in FIG. 10-B.

Thus, there is no longer the need for using fingers to give a spacing between the overlapped portions of the workpiece.

DESCRIPTION OF REFERENCE NUMERALS

1: Machine cabinet
101: Lower machine cabinet
102: Upper machine cabinet
1021: Reinforcing rod
11: Nozzle support
2: Upper belt wheel
21: Lower belt wheel
210: Hollow belt wheel
211: Needle bearing
212: Tubular connecting element
22: Protrusion
221: Magnet
222: Ball plunger
223: Spring
23: Guide groove
24: Synchronous lower belt wheel
25: Timing belt
26: Synchronous shaft
27: Upper and lower synchronous belt wheel
3: Nozzle
31: Nozzle gate
32: Nozzle column
321: Reinforcing tube
3211: Insertion hole
322: Handwheel
33: Column base
4: CW-direction bending tool
40: CCW-direction bending tool
41: Concentric hole
42: Bending tool support
43: Guide protrusion
45: Screw
44: Groove stopper

5: Strip blade material
6: Scissors-like movable tool (cutting tool)
61: Stationary blade
60: Miter cutting unit
601: Straight cutting unit
650: Higher-profile cutting tool
651: Lower-profile cutting tool
652: Through pin
653: Bar
654: Mini-cylinder
655: Elevating motor
63: Workpiece front end miter cutting edge
631: Workpiece rear end miter cutting edge
65: Cutting tool tip
7: Bridge die
71: Feed rollers

What is claimed is:

1. An automatic bending machine for automatically bending a strip blade material, and intermittently feeding a strip blade material through a nozzle until the strip blade material is jutted out from a nozzle gate at an end of the nozzle, to cause a bending tool to be turned in one of a clockwise direction or a counterclockwise direction, to strike the strip blade material for bending the same, the automatic bending machine comprising:

a CW-direction bending tool and a CCW-direction bending tool, each being provided with a bending tool support extending at right angles thereto and having a concentric hole at a top and at a bottom of each of the CW-direction bending tool and the CCW-direction bending tool, respectively, the CW-direction bending tool and the CCW-direction bending tool being superposed one upon the other, a nozzle column or a reinforcing rod provided on a top of the nozzle, and penetrating through the concentric hole, at the top of each of the CW-direction bending tool and the CCW-direction bending tool; and a lower belt wheel having a protrusion provided on a top thereof, the lower belt wheel capable of being turned under a control of a computer, the lower belt wheel being in contact with the bending tool support of each of the CW-direction bending tool and the CCW-direction bending tool.

2. The automatic bending machine for automatically bending a strip blade material of claim 1, wherein an upper belt wheel is provided in a lower machine cabinet extending from a machine cabinet in concentricity with the nozzle column or the reinforcing rod independently of the nozzle column or the reinforcing rod.

3. The automatic bending machine for automatically bending a strip blade material of claim 1, wherein the nozzle column or the reinforcing rod is connected to a reinforcing tube provided in an upper machine cabinet extending from a machine cabinet, or the reinforcing rod penetrates through the concentric hole at the top of each of CW-direction bending tool and the CCW-direction bending tool.

4. The automatic bending machine for automatically bending a strip blade material of claim 1, wherein the protrusion is a guide protrusion which is further provided with a magnet or a ball plunger as a groove stopper, and the bending tool support of each of CW-direction bending tool and the CCW-direction bending tool is a spring.

5. The automatic bending machine for automatically bending a strip blade material of claim 1, wherein an upper belt wheel is connected to a tubular connecting element inside a needle bearing provided in a lower machine cabinet extending from a machine cabinet, the tubular connecting element being turned with a hollow belt wheel being turned, the upper belt wheel is provided with a protrusion, and the nozzle column or the reinforcing rod on the nozzle, penetrating through the concentric hole at the top of each of CW-direction bending tool and the CCW-direction bending tool, is connected to an upper reinforcing tube provided in an upper machine cabinet extending from the machine cabinet.

* * * * *